US011376582B2

(12) United States Patent
Tirapu Azpiroz et al.

(10) Patent No.: US 11,376,582 B2
(45) Date of Patent: Jul. 5, 2022

(54) FABRICATION OF PAPER-BASED MICROFLUIDIC DEVICES

(71) Applicant: International Business Machines Corporation, Armonk, NY (US)

(72) Inventors: Jaione Tirapu Azpiroz, Rio de Janeiro (BR); Matheus Esteves Ferreira, Rio de Janeiro (BR); Ademir Ferreira da Silva, Sao Paulo (BR); Ricardo Luis Ohta, Sao Paulo (BR); Mathias Steiner, Rio de Janeiro (BR)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 218 days.

(21) Appl. No.: 16/293,262

(22) Filed: Mar. 5, 2019

(65) Prior Publication Data

US 2020/0282395 A1 Sep. 10, 2020

(51) Int. Cl.
*B01L 3/00* (2006.01)

(52) U.S. Cl.
CPC . *B01L 3/502715* (2013.01); *B01L 2300/0825* (2013.01); *B01L 2300/126* (2013.01); *B01L 2400/0403* (2013.01)

(58) Field of Classification Search
CPC ..... B01L 3/502715; B01L 2300/0825; B01L 2400/0403; B01L 2300/126; B01L 2400/0406; B01L 2300/161; B01L 3/502707; G01N 33/521
See application file for complete search history.

(56) References Cited

U.S. PATENT DOCUMENTS 5,043,032 A * 8/1991 Hunter ..... G01V 15/00 156/64
8,628,729 B2 1/2014 Carrilho et al.
9,365,019 B2 * 6/2016 Zhou ..... B01L 3/5023
9,594,056 B2 3/2017 Fobel et al.
9,891,207 B2 2/2018 McCord et al.
(Continued)

FOREIGN PATENT DOCUMENTS

CN 105107557 A 12/2015
CN 105833926 A 8/2016
(Continued)

OTHER PUBLICATIONS

Paulo De T. Garcia, et al., Stamping of microfluidic paper-based analytical devices with chemically modified surface for clinical diagnostics, Oct. 26, 2014.
(Continued)

*Primary Examiner* — Matthew D Krcha
*Assistant Examiner* — Sophia Y Lyle
(74) *Attorney, Agent, or Firm* — Garg Law Firm, PLLC; Rakesh Garg; Joseph Petrokaitis

(57) ABSTRACT

Fabricating a fluid testing device includes receiving a substrate, and applying a pattern of hydrophobic material to the substrate. The substrate is positioned between layers of a thermally reflective material. Heat and pressure is applied to the substrate and thermally reflective material to reflow the pattern of hydrophobic material. A protective coating is applied over a portion of the substrate to form the fluid testing device.

18 Claims, 7 Drawing Sheets

(56) References Cited

U.S. PATENT DOCUMENTS

| | | | | |
|---|---|---|---|---|
| 2012/0052250 | A1* | 3/2012 | DeRosa | B01L 3/502707 428/172 |
| 2012/0198684 | A1* | 8/2012 | Carrilho | B01L 3/502707 29/527.1 |
| 2013/0084630 | A1* | 4/2013 | Rolland | G01N 21/78 435/287.8 |
| 2014/0295415 | A1* | 10/2014 | Rolland | B01L 7/52 435/6.1 |
| 2015/0005193 | A1* | 1/2015 | Phillips | G01N 33/525 506/11 |
| 2015/0132742 | A1 | 5/2015 | Thuo et al. | |
| 2015/0367340 | A1* | 12/2015 | Beachner | B32B 37/12 422/430 |
| 2015/0367615 | A1* | 12/2015 | Zhou | B32B 37/0046 156/583.1 |
| 2016/0139102 | A1* | 5/2016 | McCord | B01L 3/5027 506/12 |
| 2016/0207039 | A1* | 7/2016 | Vella | D21H 21/16 |
| 2016/0339428 | A1 | 11/2016 | Kim et al. | |
| 2017/0067881 | A1* | 3/2017 | McCord | G01N 21/78 |

FOREIGN PATENT DOCUMENTS

| | | | | |
|---|---|---|---|---|
| CN | 105903502 | A | 8/2016 | |
| CN | 105954273 | A | 9/2016 | |
| CN | 106732840 | A | 5/2017 | |
| EP | 3225309 | A1 * | 10/2017 | B01L 3/5023 |
| EP | 3225309 | B1 * | 8/2018 | B01L 3/5023 |
| KR | 101493051 | B1 | 2/2015 | |
| WO | WO-2008049083 | A2 * | 4/2008 | G01N 33/558 |
| WO | WO-2010022324 | A2 * | 2/2010 | B01L 3/5023 |
| WO | 2018032112 | A1 | 2/2018 | |
| WO | WO-2018165180 | A1 * | 9/2018 | G01N 33/526 |

OTHER PUBLICATIONS

Gregory G. Lewis et al., High throughput method for prototyping three-dimensional, paper-based microfluidic devices. May 15, 2012.

Research Gate, Smartphone—Based Simultaneous pH and Nitrite Colorimetric Determination for Paper Microfluidic Devices, Aug. 2014.

Research Gate, Use of multiple colorimetric indicators for paper-based microfluidic devices, Aug. 2010.

Emanuel Carrllho, et al., Understanding Wax Printing: A Simple Micropatterning Process for Paper-Based Microfluidics, Jul. 15, 20019.

Kevin M. Schilling, et al., Fully Enclosed Microfluidic Paper-Based Analytical Devices, Jan. 9, 2012.

Keisuke Tenda, et al., High-Resolution Microfluidic Paper-Based Analytical Devices for Sub-Microliter Sample Analysis, May 2, 2016.

* cited by examiner

FABRICATION OF PAPER-BASED MICROFLUIDIC DEVICES

TECHNICAL FIELD

The present invention relates generally to a method for fabricating of paper-based microfluidic devices and an apparatus formed by the method. More particularly, the present invention relates to a method for fabricating a paper-based microfluidic device on an arbitrary substrate type and an apparatus formed by the method.

BACKGROUND

Paper-based microfluidic devices such as microfluidic paper-based analytical devices (microPADs or pPADs) offer great potential as a low-cost platform to perform chemical and biochemical tests. Examples of such tests include clinical and veterinary diagnostics, industrial and environmental testing, biochemical and pharmaceutical testing, and food/beverage quality control testing. Paper-based microfluidic devices rely on the phenomenon of capillary penetration in porous media to transport fluids through the microfluidic device. To control fluid penetration in porous substrates such as paper in two or three dimensions, factors such as pore structure, wettability and geometry of the microfluidic device are controlled in view of other factors such as viscosity and evaporation rate of the liquid to be tested. Many microfluidic devices use hydrophobic barriers on hydrophilic paper that passively transport fluids to output areas including chemical or biological reagents where chemical or biological reactions of the fluid with the reagents takes place.

Recently, significant progress has been made in the development of paper-based devices that integrate various processing steps to carry out chemical tests with minimum user interference. Hydrophobic barriers patterned in paper control the movement of liquids based on channel geometry that can carry the liquid and reagents according to predefined sequences. Three-dimensional microPADs often include an input layer on a first outer surface and an output layer on a second outer surface with one or more layers between. Three-dimensional microPADs offer more flexibility and potential for more elaborate flow sequences.

SUMMARY

The illustrative embodiments provide a method and apparatus. An embodiment of a method for fabricating a fluid testing device including receiving a substrate, applying a pattern of hydrophobic material to the substrate, and positioning the substrate between layers of a thermally reflective material. The embodiment further includes applying heat and pressure to the substrate and the thermally reflective material to reflow the pattern of hydrophobic material. The embodiment still further includes applying a protective coating over a portion of the substrate to form a fluid testing device.

In another embodiment, the protective coating is applied to the pattern. In another embodiment, the protective coating is applied to an output layer of the fluid testing device.

In another embodiment, applying the pattern of hydrophobic material to the substrate further includes depositing the pattern of hydrophobic material to the substrate using a printing device.

In another embodiment, applying the pattern of hydrophobic material to the substrate further includes receiving a transfer medium, applying the pattern of hydrophobic material to the transfer medium, aligning the transfer medium with the substrate, applying the heat and pressure to the transfer medium and the substrate to transfer the pattern of hydrophobic material to the target substrate, and removing the transfer medium from the substrate.

In another embodiment, the transfer medium is one of a plastic slide, a metal plate, a metal cylinder or other non-absorbing hydrophobic surface.

Another embodiment further includes applying a mask to hydrophilic portions of the substrate, applying an adhesive material to the substrate, the mask protecting the hydrophilic portions of the substrate from the adhesive material, removing the mask from the substrate, and aligning and positioning the substrate in contact with another substrate.

In another embodiment, the applying of the mask is performed before the applying of the protective coating. In another embodiment, the applying of the adhesive material is performed after the applying of the protective coating.

In another embodiment, the substrate includes a porous hydrophilic material capable of allowing the movement of fluids such as paper. In another embodiment, the hydrophobic material comprises a wax.

In another embodiment, the thermally reflective material comprises one or more laminated foil films.

In another embodiment, more than one layer of substrate is placed inside the thermally reflective material and separated by sacrificial absorbing material.

In another embodiment, the mask is applied after a chemical substance capable of undergoing chemical reaction upon contact with a fluid is deposited in the substrate.

An embodiment of an apparatus includes a substrate, and a pattern of hydrophobic material disposed on the substrate, the pattern of hydrophobic material being formed by applying the pattern of hydrophobic material to the substrate, positioning the substrate between layers of a thermally reflective material, and applying heat and pressure to the substrate and thermally reflective material to reflow the pattern of hydrophobic material. The embodiment further includes a protective coating disposed over a portion of the substrate to form a fluid testing device.

An embodiment includes a computer usable program product. The computer usable program product includes one or more computer-readable storage devices, and program instructions stored on at least one of the one or more storage devices.

In an embodiment, the computer usable code is stored in a computer readable storage device in a data processing system, and wherein the computer usable code is transferred over a network from a remote data processing system.

In an embodiment, the computer usable code is stored in a computer readable storage device in a server data processing system, and wherein the computer usable code is downloaded over a network to a remote data processing system for use in a computer readable storage device associated with the remote data processing system.

BRIEF DESCRIPTION OF THE DRAWINGS

Certain novel features believed characteristic of the invention are set forth in the appended claims. The invention itself, however, as well as a preferred mode of use, further objectives and advantages thereof, will best be understood by reference to the following detailed description of the illustrative embodiments when read in conjunction with the accompanying drawings, wherein:

DETAILED DESCRIPTION

Figure 1:
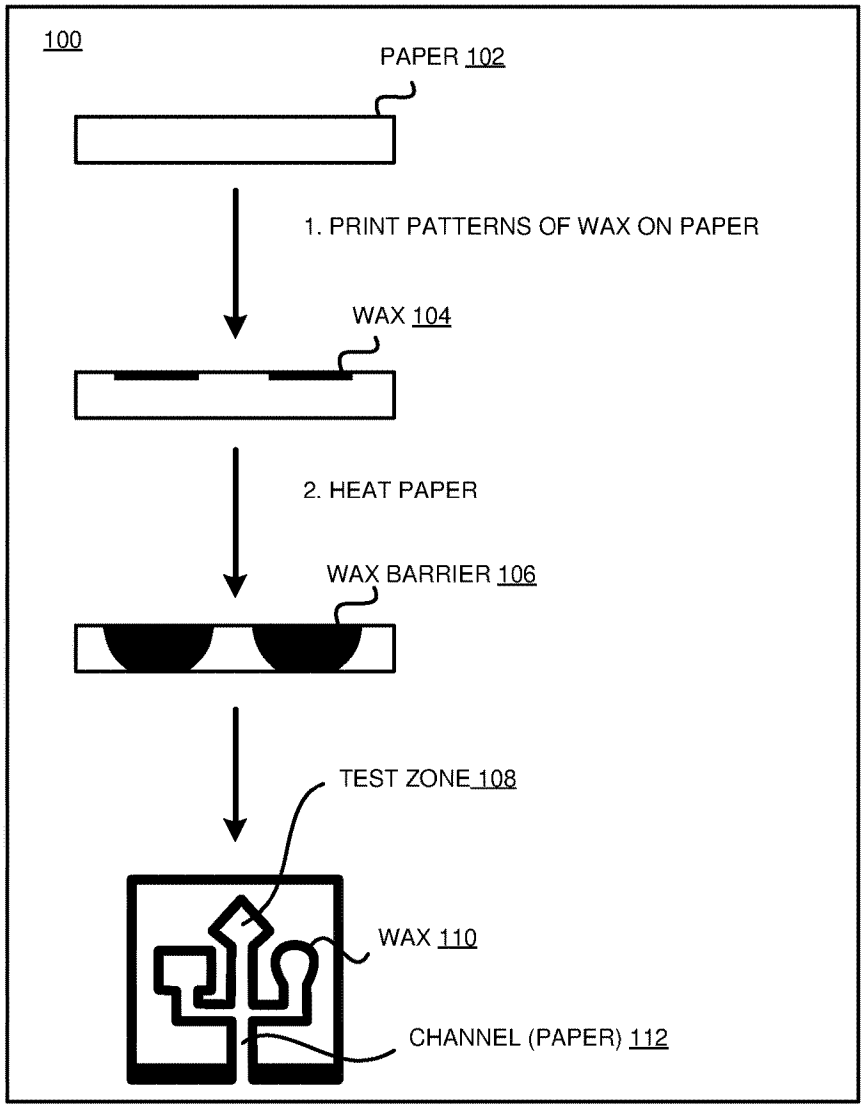
FIGURE 1 PRIOR ART
FIG. 1 depicts a conventional process for fabricating microfluidic devices.

One or more embodiments of the present invention are directed to a method for fabricating a paper-based microfluidic device on an arbitrary substrate type and an apparatus formed by the method such as porous and/or paper substrate types. Embodiments recognize that known processes for fabricating paper-based microfluidic devices typically include printing wax patterns on paper with a wax printer, and heating the paper to reflow the wax to create hydrophobic barriers. Embodiments further recognize that conventional processes further include an assembly operation in which an adhesive is indiscriminately sprayed on sheets of patterned paper to glue the layers together.

Embodiments recognize that known solutions for fabricating paper-based microfluidic devices may suffer from a number of drawbacks such as infeasibility for certain paper types, distorting of layout design during reflow, undesirable alteration of hydrophilic paper channels due to adhesive spraying, or undesirable reaction of the tested fluid during testing.

An embodiment provides for a novel process for fabricating a paper-based testing device including applying a hydrophobic material (e.g., a wax) to a substrate (e.g., paper), positioning the substrate between layers of thermally reflective material, applying heat and pressure to the substrate and layers of thermally reflective material thereby reflowing the hydrophobic material, removing the thermally reflective material, and applying a protective coating over the hydrophobic material and substrate.

Another embodiment provides for a novel process for fabricating a paper-based testing device having a patterning step including wax-printing desired geometries on a hydrophobic sacrificial layer (e.g., a transparent plastic slide), and a reflow step including placing the sacrificial layer and a target hydrophilic paper substrate in contact in an insulating thermal envelope and applying heat and pressure to transfer the hydrophobic pattern to the substrate.

In another embodiment, several patterned paper sheets are joined together through an assembly step that includes constructing a protective mask, placing the protective mask on the patterned paper layers, and spraying or applying liquid adhesive on each layer. The embodiment further includes attaching and gluing pairs of paper layers to construct a multi-layer three-dimensional (3D) paper testing device. The embodiment further includes a step in which a hydrophobic colorimetric color protection layer is applied to the final paper layer of the testing device.

Various embodiments described herein describe a multi-step process to fabricate single-layer or multi-layer 3D paper-based fluid testing devices that may provide one or more advantages over known processes including, but not limited to, providing the ability to create hydrophobic barriers on arbitrary types of porous materials, providing the ability to fabricate testing devices with high reproducibility and fidelity, providing increased repeatability of reactions, increasing yield or increasing shelf-life of the testing device.

For the clarity of the description, and without implying any limitation thereto, the illustrative embodiments are described using microfluidic devices. An embodiment can be implemented with other fluid testing devices within the scope of the illustrative embodiments.

Furthermore, simplified diagrams of the example microfluidic devices are used in the figures and the illustrative embodiments. In an actual fabrication of a microfluidic device, additional structures that are not shown or described herein may be present without departing the scope of the illustrative embodiments. Similarly, within the scope of the illustrative embodiments, a shown or described structure in the example microfluidic device may be fabricated differently to yield a similar operation or result as described herein.

A specific shape or dimension of a shape depicted herein is not intended to be limiting on the illustrative embodiments. The shapes and dimensions are chosen only for the clarity of the drawings and the description and may have been exaggerated, minimized, or otherwise changed from actual shapes and dimensions that might be used in actually fabricating a microfluidic device according to the illustrative embodiments.

Furthermore, the illustrative embodiments are described with respect to a microfluidic device only as an example. The steps described by the various illustrative embodiments can be adapted for fabricating other fluid diagnostic or testing devices, and such adaptations are contemplated within the scope of the illustrative embodiments.

An embodiment when implemented in a software application causes a fabrication system to perform certain steps as described herein. The steps of the fabrication process are depicted in the several figures. Not all steps may be necessary in a particular fabrication process. Some fabrication processes may implement the steps in different order, combine certain steps, remove or replace certain steps, or perform some combination of these and other manipulations of steps, without departing the scope of the illustrative embodiments.

A method of an embodiment described herein, when implemented to execute on a manufacturing device, tool, or data processing system, comprises substantial advancement of the functionality of that manufacturing device, tool, or data processing system in fabricating microfluidic devices.

The illustrative embodiments are described with respect to certain types of devices, layers, patterning devices, reagents, substrates, hydrophobic materials, hydrophilic materials, planes, structures, materials, dimensions, numerosity, data processing systems, environments, components, and applications only as examples. Any specific manifestations of these and other similar artifacts are not intended to be limiting to the invention. Any suitable manifestation of these and other similar artifacts can be selected within the scope of the illustrative embodiments.

The examples in this disclosure are used only for the clarity of the description and are not limiting to the illustrative embodiments. Additional data, operations, actions, tasks, activities, and manipulations will be conceivable from this disclosure and the same are contemplated within the scope of the illustrative embodiments.

Any advantages listed herein are only examples and are not intended to be limiting to the illustrative embodiments. Additional or different advantages may be realized by specific illustrative embodiments. Furthermore, a particular illustrative embodiment may have some, all, or none of the advantages listed above.

With reference to FIG. 1, this figure depicts a conventional process 100 for fabricating microfluidic devices such as according to Carrilho et al. ["Understanding Wax Printing: A Simple Micropatterning Process for Paper-Based Microfluidics". E. Carrilho, A. W. Martinez and G. M. Whitesides. Anal. Chem. 2009, 81, 7091-7095]. In process 100, a paper substrate 102 is received and patterns of wax 104 are printed on a surface of paper substrate 102 with a printing device. The paper is then heated by a heating device, such as a hotplate, to reflow the wax to extend through the thickness of paper substrate 102 to form a wax barrier 106. As a result of patterning and reflow, a test zone 108 and channel 112 is defined by wax pattern 110. For assembly of multilayer microfluidic devices, adhesive is indiscriminately sprayed on sheets containing multiple copies of patterned paper and the layers are stacked to glue the layers together to form to form a microfluidic device such as described by Lewis et al. ["High throughput method for prototyping three-dimensional, paper-based microfluidic devices." G. G. Lewis, M. J. DiTucci, M. S. Baker and S. T. Phillips. Lab on a Chip 12(15):2630-3 (2012)].

During testing of a liquid, the liquid flows through channel 112 to test zone 108 which includes one or more reagents to react with the fluid to indicate a testing result. Chemical reactions that produce a colorimetric output are commonly used since they do not typically require electrical, optical, or other types of equipment to indicate the testing result.

As previously discussed, known conventional processes such as illustrated in FIG. 1 may suffer from a number of drawbacks. During patterning, wax printing directly on paper is not always feasible on all substrate types such as for highly porous or very thick substrates. In addition, during the reflow process necessary to melt printed wax features and impregnate the paper thickness to create hydrophobic barriers may cause in plane diffusion that distorts the original layout design. Using hot lamination may reduce wax spread and allow more controlled fabrication, but challenges remain. Laminator heat is often not enough for reflow to impregnate the entire paper thickness, requiring several repetitions/passes. Also, excess way may damage laminator cylinders of laminating devices. Further, multiplexing several sheets may be desirable but interference may be a concern.

Further, conventional microfluidic device assembly processes involve indiscriminately spraying glue to entire patterned sheets to attach the sheets together which may cause hydrophilic paper channels to turn hydrophobic and prevent flow of fluid. In addition, during reaction of the microfluidic device with a test fluid, evaporation can affect the dynamics of colorimetric tests producing loss of color, non-uniform spot coverage, and/or undesired changes over time.

Figure 2:
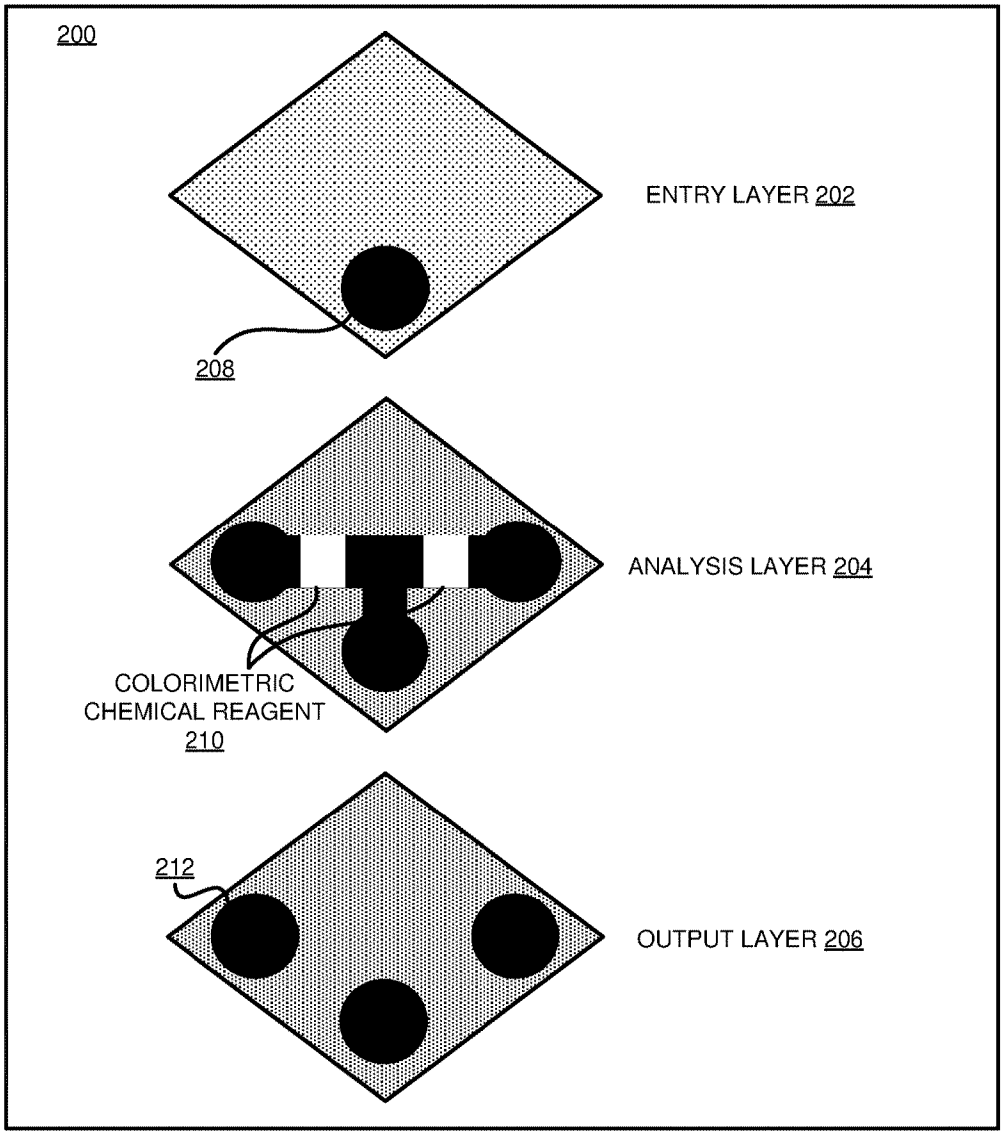
FIG. 2 depicts a simplified diagram of a three dimensional (3D) microfluidic device in accordance with an illustrative embodiment.

With reference to FIG. 2, this figure depicts a simplified diagram of a three dimensional (3D) microfluidic device 200 in accordance with an illustrative embodiment. In the embodiment, microfluidic device 200 is a multilayer device including an entry layer 202, an analysis layer 204, and an output layer 206. Entry layer 202 includes a sample input portion 208, analysis layer 204 includes a colorimetric chemical reagent portion 210 including one or more chemical reagents, and output layer includes colorimetric result portions 212. In the illustrated embodiment, input portion 208, colorimetric chemical reagent portion 210, and colorimetric result portions 212 are formed of hydrophilic substrates (e.g., paper) constrained by hydrophobic material (e.g., a wax) deposited on the substrate.

During use of microfluidic device 200, a fluid to be tested is applied to sample input portion 208 of entry layer 202. The fluid flows to chemical reagent portion 210 of analysis layer 204 and reacts with the chemical reagents to produce one or more colorimetric results. The colorimetric results are viewable in colorimetric result portions 212 of output layer 206.

Figure 3:
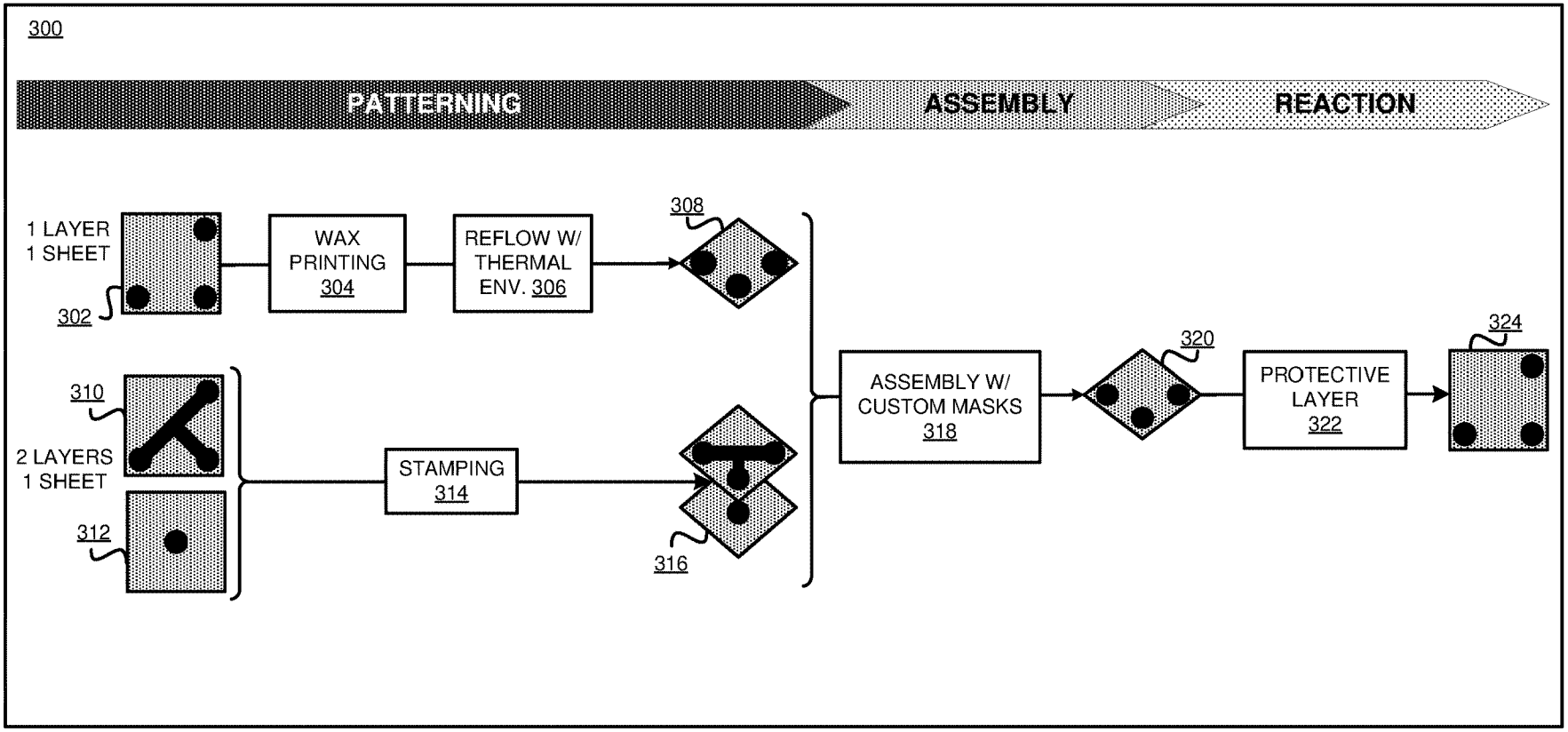
FIG. 3 depicts simplified processes for fabricating a paper-based microfluidic device in accordance with illustrative embodiments.

With reference to FIG. 3, this figure depicts simplified processes 300 for fabricating a paper-based microfluidic device in accordance with illustrative embodiments. The embodiments of FIG. 3 illustrate a first process using wax printing to produce a microfluidic device, and a second alternative process using a stamping method to produce a microfluidic device. In the first process, a single patterned layer on a single sheet is produced from printing a predetermined pattern layout of wax or other hydrophobic material upon a target substrate 302 using a wax printing process 304. In an embodiment, target substrate 302 is a paper substrate such as cellulose chromatography paper. Although various embodiments discussed herein are described as printing a wax material upon a substrate, it should be understood that in other embodiments any suitable hydrophobic material may be printed upon a substrate.

During a reflow process 306, one or more printed sheets of substrate 302 are inserted into a thermal envelope (e.g., an isothermal envelope) between layers of thermally reflective material, and may be separated by sacrificial absorption paper sheets for protection. In particular embodiments, the thermal envelope includes laminated foil film covers with one or more internal wax absorption layers to create an isothermal environment or cavity for more uniform reflow heat distribution through the substrate thickness. The thermal envelope is inserted into a laminator device, and the laminator device applies heat and pressure to the thermal envelope and substrate to reflow the wax or other hydrophobic material. In particular embodiments, the laminator device may apply several passes at particular temperatures according to a laminator optimized recipe. A particular example of a laminator optimized recipe may include heating to approximately 150 degrees Celsius (C) and applying five passes for a one sided layer of substrate or eight passes for three sheets of a one-sided layer of substrate.

Alternatively, the thermal envelope may be inserted in a hot press instead of a laminator device to apply heat and pressure to the thermal envelope and substrate and a hot press optimized recipe is applied. A particular example of a hot press optimized recipe may include heating to approximately 200 degrees C. for 200 seconds for a single layer of substrate. The patterned sheets are then removed from the thermal envelope to produce a substrate with a patterned hydrophobic wax layout 308.

One or more advantages that may be provided in one or more embodiments by the reflow process 306 using a thermal envelope such as reduced in-plane wax diffusion during reflow, reduced channel wall roughness, increased yield, reduced waste, or reduced wax leakage. Other advantages that may be provide in one or more embodiments include providing for simultaneous reflow of larger printed areas and the possibility of multiplexing of several sheets for increased throughput.

During an assembly process 318, a customized mask is created and applied to substrate with a patterned hydrophobic wax layout 308. In particular embodiments, the mask is constructed of a wooden, plastic, and/or metal material. In the embodiment the mask covers and protects hydrophilic portions of the substrate, and an adhesive spray is applied to the substrate. In the embodiment, the mask protects the hydrophilic portions from becoming hydrophobic due to contamination by the adhesive spray. The mask is then separated from substrate 308 and the process is repeated for each layer. The layers are stacked to form a layer stack 320.

In a protective layer process 322, a protective coating including hydrophobic material is applied over the output layer surface of the substrate to form a microfluidic device 324. In one or more embodiments, the protective coating improves uniformity of colorimetric output and reduces evaporation effects by adding a hydrophobic protective layer about the colorimetric output. Various methods may be used to apply the protective coating according to one or more embodiments including, but not limited to: (1) applying a plastic cover via a lamination step (e.g., 110 degrees C. for 45 seconds per sheet using a laminator device); (2) parafilm protective layer adhesion through a heating step (e.g., 60 degrees C. for 10 seconds per sheet in a hot-press); (3) applying an adhesive transparent layer on one side via pressure; or (4) impermeabilizer spraying and drying in which no heat or pressure is required).

Still with reference to FIG. 3, the second alternative process using a stamping process 314 includes transferring a wax (or other hydrophobic) design from a printer to an intermediate surface, and then transferring the design from the intermediate surface to a substrate (e.g., paper) through a heating step that enables creating hydrophobic barriers within arbitrary types of substrates (e.g., varying thickness and/or varying porosity). During stamping process 314, hydrophobic (e.g., wax) layouts are printed on transfer medium such as a plastic slide, metal plate, or metal cylinder). In the illustrated embodiments, a first transfer medium 310 and a second transfer medium 312 are used to transfer layouts to a substrate. The transfer surfaces of first transfer medium 310 and second transfer medium 312 are aligned with each other if a top and bottom layouts exit and aligned with the test substrate in a stacked arrangement. The stack is heated and pressure is applied resulting in the hydrophobic layout being transferred from the transfer medium surfaces into a thickness of the pattern hydrophobic layout 316. In the illustrated embodiment, two patterned layers are produced on a single sheet of paper. Alternative embodiments may use the same geometric wax pattern on both sides of the paper substrate. In yet another embodiment, the stamping method may be used on a single side of the substrate only.

An advantage that may be provided by stamping process 314 in one or more embodiments includes that the process may be applicable to any substrate regardless of size, weight, thickness, etc. Another advantage that may be provided by stamping process 314 in one or more embodiments includes providing for the capability of multilayer wax deposition by resolving problems with alignment between both substrate sides which may be problematic for wax printers.

In the embodiment, in a similar manner as described with respect to the first process, assembly process 318, a customized mask is created and applied to substrate with a patterned hydrophobic layout 316. The mask is then separated from substrate and the process is repeated for each layer. The layers are stacked to form a layer stack 320. In protective layer process 322, the protective coating including hydrophobic material is applied over the output layer surface of the substrate to form a microfluidic device 324.

Figure 4:
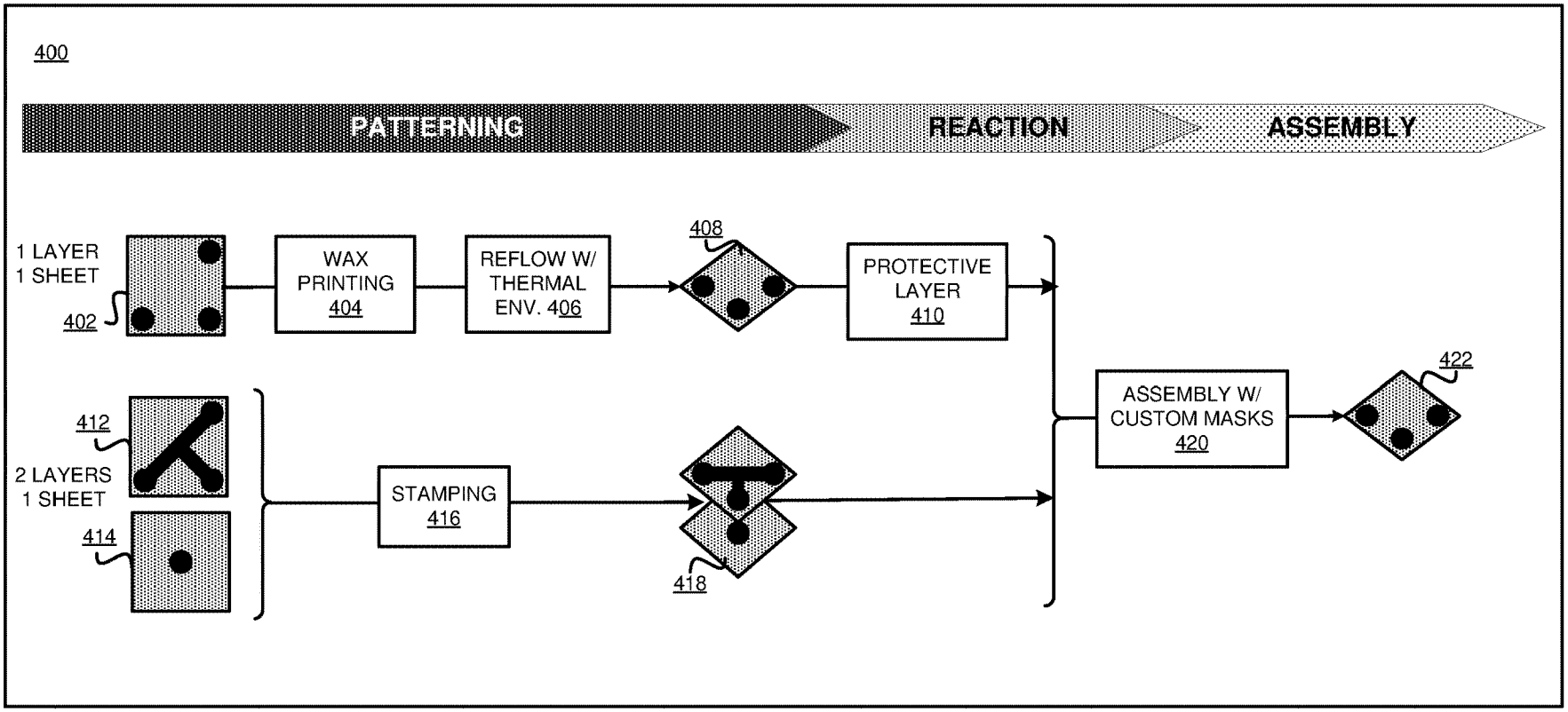
FIG. 4 depicts simplified processes for fabricating a paper-based microfluidic device in accordance with other illustrative embodiments.

With reference to FIG. 4, this figure depicts simplified processes 400 for fabricating a paper-based microfluidic device in accordance with other illustrative embodiments. The embodiments of FIG. 4 are similar to those described with respect to FIG. 3 except that the protective hydrophobic layer can be applied before assembly in order to protect chemical reagents integrated into the substrate from high temperatures. The embodiments of FIG. 4 illustrate a first process using wax printing to produce a microfluidic device, and a second alternative process using a stamping method to produce a microfluidic device. In the first process, a single patterned layer on a single sheet is produced from printing a predetermined pattern layout of wax or other hydrophobic material upon a target substrate 402 using a wax printing process 404.

During a reflow process 406, one or more printed sheets of substrate 402 are inserted into a thermal envelope between layers of thermally reflective material, and may be separated by sacrificial absorption paper sheets for protection. The thermal envelope is inserted into a laminator device, and the laminator device applies heat and pressure to the thermal envelope and substrate to reflow the wax or other hydrophobic material. Alternatively, the thermal envelope may be inserted in a hot press instead of a laminator device to apply heat and pressure to the thermal envelope and substrate and a hot press optimized recipe is applied. The patterned sheets are then removed from the thermal envelope to produce a substrate with a patterned hydrophobic wax layout 408.

In a protective layer process 410, a protective coating including hydrophobic material is applied over the output layer surface of the substrate. During an assembly process 420, a mask is created and applied to the substrate 408. In the embodiment the mask covers and protects hydrophilic portions of the substrate, and an adhesive spray is applied to the substrate. In the embodiment, the mask protects the hydrophilic portions from becoming hydrophobic due to contamination by the adhesive spray. The mask is then separated from substrate 408 and the process is repeated for each layer. The layers are stacked to form a microfluidic device 422.

Still with reference to FIG. 4, the second alternative process using a stamping process 416 includes transferring a wax (or other hydrophobic) design from a printer to an intermediate surface, and then transferring the design from the intermediate surface to a substrate (e.g., paper) through a heating step that enables creating hydrophobic barriers within arbitrary types of substrates (e.g., varying thickness and/or varying porosity). During stamping process 416, hydrophobic (e.g., wax) layouts are printed on transfer medium such as a plastic slide, metal plate, or metal cylinder. In the illustrated embodiments, a first transfer medium 412 and a second transfer medium 414 is used to transfer layouts to a substrates. The transfer surfaces of first transfer medium 412 and second transfer medium 414 are aligned with each other if a top and bottom layouts exit and aligned with the test substrate in a stacked arrangement. The stack is heated and pressure is applied resulting in the hydrophobic layout being transferred from the transfer medium surfaces into a thickness of the pattern hydrophobic layout 418. In the illustrated embodiment, two patterned layers are produced on a single sheet of paper. Alternative embodiments may use the same geometric wax pattern on both sides of the paper substrate. In yet another embodiment, the stamping method may be used on a single side of the substrate only.

In protective layer process 410, a protective coating including hydrophobic material is applied over the output layer surface of substrate 408. During assembly process 420, a mask is created and applied to the substrate 418. In the embodiment the mask covers and protects hydrophilic portions of the substrate, and an adhesive spray is applied to the substrate. In the embodiment, the mask protects the hydrophilic portions from becoming hydrophobic due to contamination by the adhesive spray. The mask is then separated from substrate 418 and the process is repeated for each layer. The layers are stacked to form microfluidic device 422.

Figure 5:
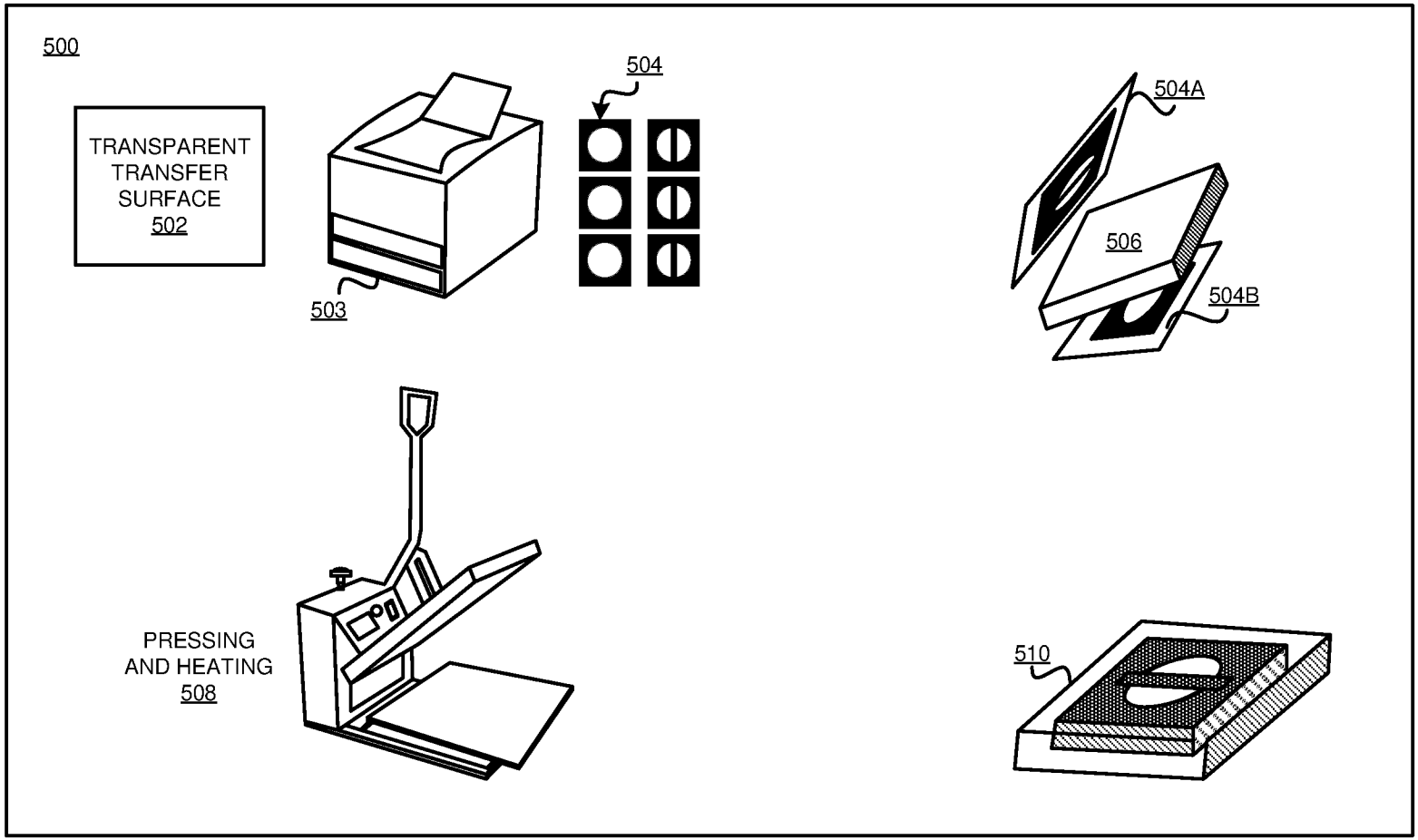
FIG. 5 depicts simplified stamping process for depositing a hydrophobic pattern on a substrate during fabrication of a microfluidic device in accordance with an illustrative embodiment.

With reference to FIG. 5, this figure depicts a simplified stamping process 500 for depositing a hydrophobic pattern on a substrate during fabrication of a microfluidic device in accordance with an illustrative embodiment. In the embodiment, a transparent transfer surface 502 of a transfer medium is provided to a wax printer 503. In the illustrated embodiment, the wax printer 503 prints a wax pattern layout 504 on one or more transfer mediums to produce a first transfer surface 504A and a second transfer surface 504B. In the embodiment, first transfer surface 504A is aligned with a top surface of a substrate 506, and second transfer surface 504B is aligned with a bottom surface of substrate 506. Further, first transfer surface 504A and second transfer surface 504B are aligned with one another to form a stack. In a particular embodiment, substrate 506 is a paper substrate.

In the embodiment, pressing and heating 508 is applied to the stack. In a particular embodiment, the stack is heated at approximately 150 degrees C. for one minute under pressure using a hot press. As a result, the wax pattern layout is transferred from first transfer surface 504A and second transfer surface 504B to the top and bottom surfaces, respectively, of substrate 506 to form wax patterned substrate 510. Accordingly, a process is provided for transferring a wax or other hydrophobic material design from a printer to an intermediate surface, and from the intermediate surface to a substrate through heating to enable creating of hydrophobic barriers within arbitrary types of substrates of varying materials (e.g., paper fibers), varying thickness, or varying porosity. Further, a process is provided for creating 3D hydrophobic geometries by patterning both sides of a substrate with accurate alignment. In another illustrative embodiment, hydrophobic material design may be transferred to the intermediate surfaces by means alternative to wax printing such as stencil transfer.

Figure 6:
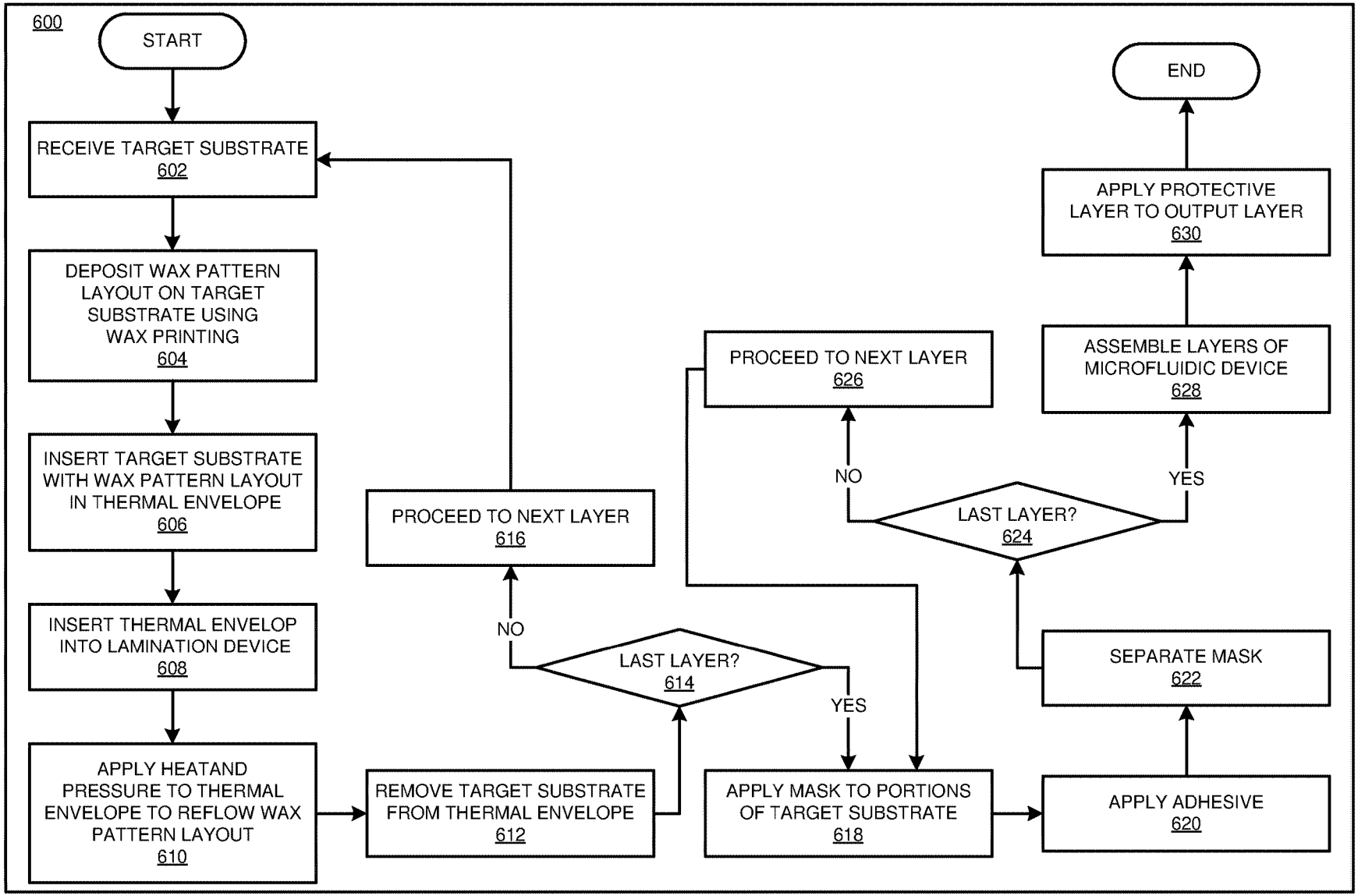
FIG. 6 depicts a flowchart of an example process for fabricating a microfluidic device in accordance with an illustrative embodiment.

With reference to FIG. 6, this figure depicts a flowchart of an example process 600 for fabricating a microfluidic device in accordance with an illustrative embodiment. In block 602, a printing device of a fabrication system receives a target substrate. In a particular embodiment, the target substrate is a paper substrate. In block 604, the printing device deposits a wax (or other hydrophobic material) pattern layout on the target substrate using a wax printing process. In block 606, the target substrate with the wax pattern layout is inserted into a thermal envelope or other isothermal environment. In particular embodiments, the thermal envelope includes laminated foil film covers with one or more internal wax absorption layers to create an isothermal environment or cavity for more uniform reflow heat distribution through the substrate thickness.

In block 608, the thermal envelope and substrate is inserted into a lamination device. In block 610, heat and pressure is applied to the thermal envelope and substrate by the lamination device to reflow the wax pattern layout. In particular embodiments, the lamination device may apply several passes at particular temperatures according to a laminator optimized recipe. Alternatively, the thermal envelope may be inserted in a hot press instead of a lamination device to apply heat and pressure to the thermal envelope and substrate using hot press optimized recipe.

In block 612, the target substrate is removed from the thermal envelope to produce a substrate with a patterned hydrophobic wax layout. In block 614, the fabrication system determines whether the current layer is the last layer of the microfluidic device. If the current layer is not the last layer, in block 616 the fabrication system proceeds to the next layer and process 600 returns to block 602.

If the current layer is the last layer, process 600 proceeds to block 618. In block 618, the fabrication applies a mask to mask hydrophilic portions of the target substrate. In block 620, the fabrication system applies an adhesive to the substrate. In block 622, the fabrication separates the mask from the substrate. In block 624, the fabrication system determines whether the last layer of the microfluidic device has had adhesive applied. If the last layer has not had adhesive applied, in block 626 the fabrication system proceeds to the next layer and process 600 returns to block 618.

If the last layer has had adhesive applied, in block 628 the layers of the microfluidic device are assembled in a layer stack. In block 630, the fabrication system applies a protective layer including a hydrophobic material to an output layer of the substrate to form a microfluidic device. Process 600 then ends.

Figure 7:
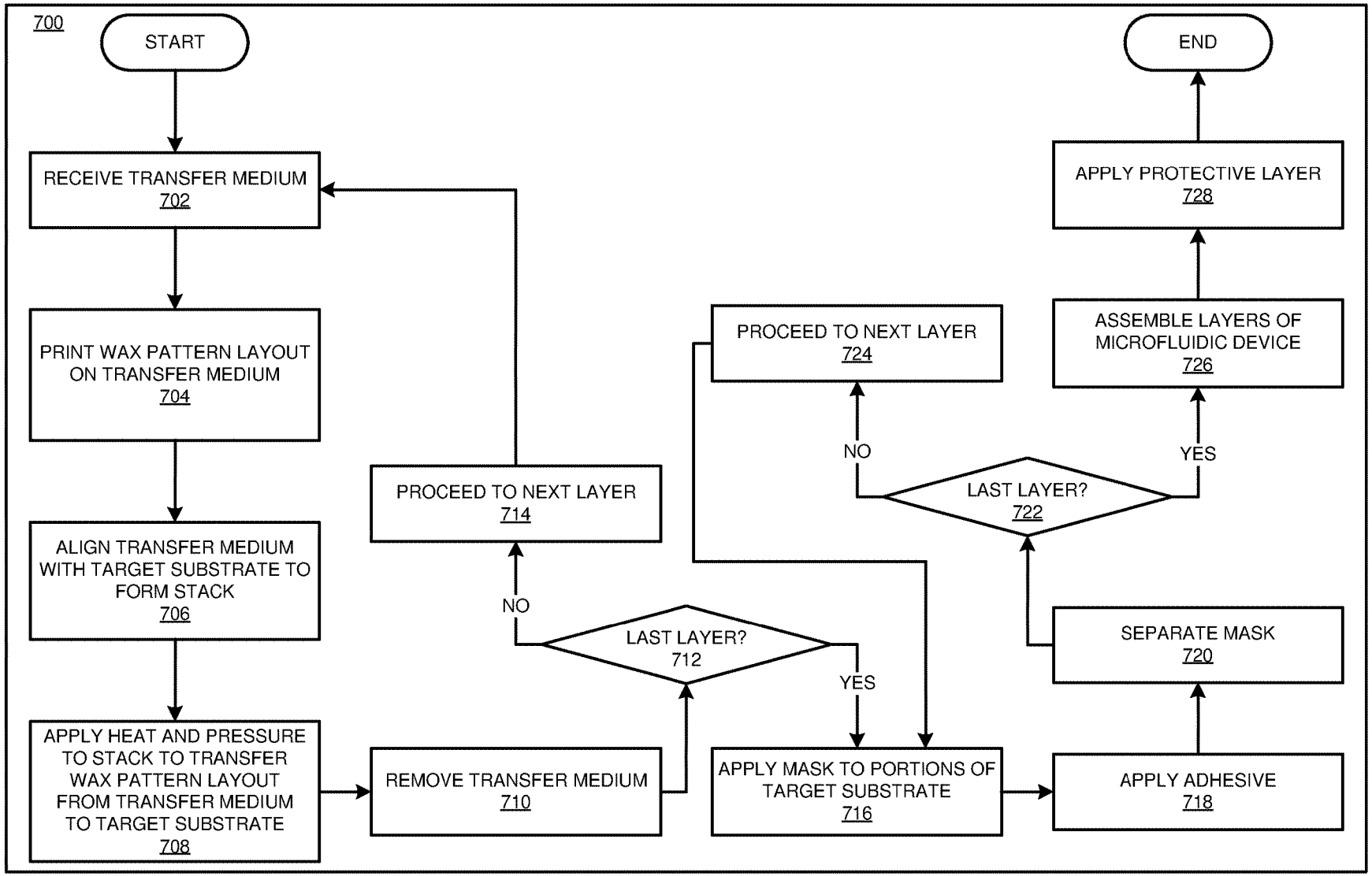
FIG. 7 depicts a flowchart of another example process for fabricating a microfluidic device in accordance with an illustrative embodiment.

With reference to FIG. 7, this figure depicts a flowchart of another example process 700 for fabricating a microfluidic device in accordance with an illustrative embodiment. In block 702, a fabrication system receives a transfer medium. In particular embodiments, the transfer medium is a transparent medium. In other particular embodiments, the transfer medium may include a plastic slide or sheet, a metal plate, or a metal cylinder. In block 704, a printing device of the fabrication system prints a wax pattern layout or other hydrophobic material pattern layout on the transfer medium.

In block 706, the fabrication system aligns the transfer medium with a target substrate to form a stack. In block 708, the fabrication system applies heat and pressure to the stack to transfer the wax pattern layout to the target substrate. In a particular embodiment, the fabrication system uses a hot stamping process to transfer the wax pattern layout to the target substrate. In block 710, the fabrication system removes the transfer medium.

In block 712, the fabrication system determines whether the current layer is the last layer of the microfluidic device. If the current layer is not the last layer, in block 714 the fabrication system proceeds to the next layer and process 700 returns to block 702.

If the current layer is the last layer, process 700 proceeds to block 716. In block 716, the fabrication applies a mask to mask hydrophilic portions of the target substrate. In block 718, the fabrication system applies an adhesive to the substrate. In block 720, the fabrication separates the mask from the substrate. In block 722, the fabrication system determines whether the last layer of the microfluidic device has had adhesive applied. If the last layer has not had adhesive applied, in block 724 the fabrication system proceeds to the next layer and process 700 returns to block 716.

If the last layer has had adhesive applied, in block 726 the layers of the microfluidic device are assembled in a layer stack. In block 728, the fabrication system applies a protective layer including a hydrophobic material to an output layer of the substrate to form a microfluidic device. Process 700 then ends.

An advantage that may be provided by an embodiment is that 2D and 3D channel fabrication on arbitrary substrate types (e.g., paper, very thick substrates, or very porous substrates) are enabled by means of a novel "stamping" process. In an embodiment, the stamping process may also resolve issues with alignment when using a printing device on both sides of a substrate. Another advantage that may be provided by an embodiment is of improved fidelity and repeatability by means of a reflow process using a novel thermal envelope process for reduced reflow-induced wax diffusion. Another advantage that may be provided by an embodiment is the use of a thermal envelope may increase yield and throughput as well as reduce waste. Another advantage that may be provided by an embodiment is that the patterning processes are compatible with various heating techniques such as hot-press, lamination, or hot cylinders.

Another advantage that may be provided by an embodiment is that of increased yield can be achieved by the improved assembly process utilizing a custom spraying mask that prevents adhesive from reaching unwanted areas and rendering channels hydrophobic.

Another advantage that may be provided in an embodiment is that improved uniformity and coverage of colorimetric output regions or other output layer regions and longer result persistence by reducing evaporation effects via the addition of a hydrophobic protective coating. Another advantage that may be provided by an embodiment is that a protective coating may provide enhanced protection for reagents embedded in a substrate (e.g., a paper fiber matrix), thus provided longer shelf-life for the microfluidic device.

Thus, a computer implemented method, system or apparatus, and computer program product are provided in the illustrative embodiments for fabricating a microfluidic device and other related features, functions, or operations. Where an embodiment or a portion thereof is described with respect to a type of device, the computer implemented method, system or apparatus, the computer program product, or a portion thereof, are adapted or configured for use with a suitable and comparable manifestation of that type of device.

Where an embodiment is described as implemented in an application, the delivery of the application in a Software as a Service (SaaS) model is contemplated within the scope of the illustrative embodiments. In a SaaS model, the capability of the application implementing an embodiment is provided to a user by executing the application in a cloud infrastructure. The user can access the application using a variety of client devices through a thin client interface such as a web browser (e.g., web-based e-mail), or other light-weight client-applications. The user does not manage or control the underlying cloud infrastructure including the network, servers, operating systems, or the storage of the cloud infrastructure. In some cases, the user may not even manage or control the capabilities of the SaaS application. In some other cases, the SaaS implementation of the application may permit a possible exception of limited user-specific application configuration settings.

The present invention may be an apparatus, a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method for fabricating a fluid testing device comprising:

receiving a substrate;

applying a pattern of hydrophobic material to the substrate, the applying comprising forming a stack, the forming of the stack comprising:

applying a first pattern layout of hydrophobic material on a first transfer surface;

applying a second pattern layout of hydrophobic material on a second transfer surface; and aligning the first transfer surface with the substrate and with the second transfer surface;

inserting the stack into a thermal envelope that includes an internal absorption layer and layers of a thermally reflective material, wherein the inserting of the stack includes inserting the stack between the layers of the thermally reflective material and separating the stack from a second substrate of another stack by the internal absorption layer;

applying heat and pressure to the stack and the thermally reflective material to reflow the first and second pattern layouts of hydrophobic material onto respective opposite sides of the substrate to form the pattern of hydrophobic material;

applying a mask to hydrophilic portions of the substrate;

applying an adhesive material to the substrate, the mask protecting the hydrophilic portions of the substrate from the adhesive material; and applying a protective coating over a portion of the substrate to form a fluid testing device.

2. The method of claim 1, wherein the protective coating is applied to the pattern.

3. The method of claim 1, wherein the protective coating is applied to an output layer of the fluid testing device.

4. The method of claim 1, wherein applying the pattern of hydrophobic material to the substrate further comprises:

depositing the first pattern layout of hydrophobic material to the first transfer surface using a printing device.

5. The method of claim 1, wherein applying the pattern of hydrophobic material to the substrate further comprises:

receiving a transfer medium;

applying the first pattern layout of hydrophobic material to the transfer medium, wherein the first transfer surface is a surface of the transfer medium;

aligning the transfer medium with the substrate;

applying the heat and pressure to the transfer medium and the substrate to transfer the pattern of hydrophobic material to the substrate; and removing the transfer medium from the substrate.

6. The method of claim 5, wherein the transfer medium is one of a plastic slide, a metal plate, a metal cylinder or other non-absorbing hydrophobic surface.

7. The method of claim 1, further comprising:

removing the mask from the substrate; and aligning and positioning the substrate in contact with another substrate.

8. The method of claim 7, wherein the applying of the mask is performed before the applying of the protective coating.

9. The method of claim 8, wherein the applying of the adhesive material is performed after the applying of the protective coating.

10. The method of claim 1, wherein the substrate includes a porous hydrophilic material capable of allowing the movement of fluids.

11. The method of claim 1, wherein the hydrophobic material comprises a wax.

12. The method of claim 1, wherein the thermally reflective material comprises one or more laminated foil films.

13. The method of claim 7, wherein the mask is applied after a chemical substance capable of undergoing chemical reaction upon contact with a fluid is deposited in the substrate.

14. A computer usable program product comprising one or more non-transitory computer-readable storage mediums, and program instructions stored on at least one of the one or more non-transitory computer-readable storage mediums, the stored program instructions comprising:

program instructions to receive a substrate;

program instructions to apply a pattern of hydrophobic material to the substrate, the applying comprising forming a stack, the forming of the stack comprising:

applying a first pattern layout of hydrophobic material on a first transfer surface;

applying a second pattern layout of hydrophobic material on a second transfer surface; and aligning the first transfer surface with the substrate and with the second transfer surface;

program instructions to insert the stack into a thermal envelope that includes an internal absorption layer and layers of a thermally reflective material, wherein the inserting of the stack includes inserting the stack between the layers of the thermally reflective material and separating the stack from a second substrate of another stack by the internal absorption layer;

program instructions to apply heat and pressure to the stack and the thermally reflective material to reflow the first and second pattern layouts of hydrophobic material onto respective opposite sides of the substrate to form the pattern of hydrophobic material;

program instructions to apply a mask to hydrophilic portions of the substrate;

program instructions to apply an adhesive material to the substrate, the mask protecting the hydrophilic portions of the substrate from the adhesive material; and program instructions to apply a protective coating over a portion of the substrate to form a fluid testing device.

15. The computer usable program product of claim 14, wherein the computer usable code is stored in a computer readable storage medium in a data processing system, and wherein the computer usable code is transferred over a network from a remote data processing system.

16. The computer usable program product of claim 14, wherein the computer usable code is stored in a computer readable storage medium in a server data processing system, and wherein the computer usable code is downloaded over a network to a remote data processing system for use in a computer readable storage medium associated with the remote data processing system.

17. The method of claim 1, wherein the first pattern layout of hydrophobic material is different from the second pattern layout of hydrophobic material.

18. The method of claim 1, further comprising:

performing a patterning iteration of the applying of the pattern of hydrophobic material, the inserting of the stack into the thermal envelope, and the applying of the heat and pressure to the stack, for each layer of the fluid testing device;

determining, after each patterning iteration, whether patterning iterations have been performed for every layer of the fluid testing device;

performing, responsive to determining that patterning iterations have been performed for every layer of the fluid testing device, a masking iteration of the applying of the mask and the applying of the adhesive material for each layer of the fluid testing device;

determining, after each masking iteration, whether masking iterations have been performed for every layer of the fluid testing device; and assembling, responsive to determining that masking iterations have been performed for every layer of the fluid testing device, the layers into a layer stack.

* * * * *